US005458816A

United States Patent [19]

Ebner et al.

[11] Patent Number: 5,458,816

[45] Date of Patent: Oct. 17, 1995

[54] APPARATUS FOR AERATING AND/OR ANAEROBICALLY MIXING LIQUIDS

[75] Inventors: Heinrich Ebner, Linz, Austria; Karl Golob; Konrad Ditscheid, both of Bonn, Germany

[73] Assignee: Heinrich Frings GmbH & Co. KG, Bonn, Germany

[21] Appl. No.: 286,486

[22] Filed: Aug. 4, 1994

[30] Foreign Application Priority Data

Sep. 29, 1993 [AT] Austria ..... 1959/93

[51] Int. Cl.[6] ..... B01F 3/04

[52] U.S. Cl. ..... 261/64.1; 261/93; 261/87

[58] Field of Search ..... 261/87, 93, 64.1

[56] References Cited

U.S. PATENT DOCUMENTS

| | | | |
|---|---|---|---|
| 2,609,189 | 9/1952 | Dering | 261/87 |
| 3,891,729 | 6/1975 | Ebner et al. | 261/93 |
| 3,953,552 | 4/1976 | Strauss | 261/93 |
| 4,193,949 | 3/1980 | Naito et al. | 261/93 |
| 4,925,598 | 5/1990 | Kivisto et al. | 261/87 |
| 5,356,570 | 10/1994 | Golob et al. | 261/93 |

*Primary Examiner*—Tim R. Miles
*Attorney, Agent, or Firm*—Norbert P. Holler

[57] ABSTRACT

An apparatus for selectively aerating or anaerobically mixing a liquid in a container includes a hollow, star-shaped, multi-vaned rotor (6) arranged in the bottom region of the container (1) for rotation about a vertical axis. The hollow interior of the rotor at one of the two opposite faces thereof is in communication with a gas feed line (15), and each of the vanes (10) at its trailing flank (11), as viewed in the direction of rotation of the rotor, is provided with a respective gas exit opening (12). The inter-vane spaces of the rotor are open at one of its two opposite faces for admitting liquid from the container into those spaces. The rotor is surrounded by a stator (7) providing a plurality of circumferentially spaced flow channels (9) for receiving and guiding away either liquid with admixed gas when gas flows through the gas feed line or liquid without admixed gas when no gas flows through the gas feed line. The rotor is provided in its inter-vane spaces with respective guide plates (18) interposed between the gas exit openings and the liquid entry locations for shielding the gas exit openings and for preventing liquid in the intervane spaces from being sucked into the rotor through the gas exit openings when no gas is flowing through the gas feed line.

18 Claims, 4 Drawing Sheets

APPARATUS FOR AERATING AND/OR ANAEROBICALLY MIXING LIQUIDS

This invention relates to an apparatus for selectively aerating or anaerobically mixing a liquid in a container therefor. Although the invention is applicable to the treatment of various types of liquids for various purposes, it will be described herein primarily as applied to the treatment of waste water, in a tank, a basin, a lagoon, or the like, for purification or clarification thereof.

BACKGROUND OF THE INVENTION

In U.S. Pat. No. 3,891,729, which is assigned to the same assignee as the present application, there is disclosed an apparatus for aerating a liquid in a container therefor. The apparatus includes a hollow, star-shaped, multi-vaned rotor arranged in the bottom region of the container for rotation about a vertical axis, with the hollow interior of the rotor being in communication at its lower horizontal face with one end of a gas feed line the other end of which (in the most usual situation) is open to the ambient atmosphere outside the container at a location generally above the surface of the body of liquid therein. The rotor, as viewed in its direction of rotation, is provided at the trailing sides or flanks of its outwardly directed vanes with a respective set of gas exit openings, so that, as the rotor revolves at relatively high speeds, air is aspirated into its interior. Through its rotation, the rotor transports liquid located in the respective spaces between the various adjacent vanes outwardly of the rotor by means of the vertical leading flanks of the vanes, with the leading flank of each vane making an acute angle with a radial plane passing through the tip of that vane, the liquid having entered the inter-vane spaces from above and below the rotor. The aspirated air leaves the rotor through its gas exit openings and is transported outwardly of the rotor together with the liquid. A stator surrounds the rotor, the stator being formed by an upper and a lower ring and at least twelve circumferentially spaced vertical guide plates oriented at respective acute angles to the radial direction. Gas and liquid are mixed in the angular inter-vane spaces of the rotor and in the flow channels of the stator defined by the guide plates. The so-formed gas-liquid mixture is transported outwardly of and away from the rotor into the body of liquid in the container.

Similar aeration devices exist, in which the inflow of the liquid to the rotor is from above only and the aspiration of the air or gas is also from above.

In order to enable the treatment facility to not only purify waste water by an oxidative decomposition of the organic substances contained therein, but also to remove the even then still remaining nitrogen from the waste water by means of an anaerobic after-treatment, the waste water must be carefully mixed so that the sludge formed therein will be maintained in suspension. However, inasmuch as in the case of an anaerobic after-treatment of the waste water, an intake of air (oxygen) through the surface of the body of liquid must be inhibited to the greatest possible extent, it is essential that, during such mixing of the waste water, the surface of the body of liquid be kept as calm and undisturbed as possible.

All of the above-described known apparatus are advantageously well suited for aerating a liquid, but not for effecting only a limited mixing of the liquid in the absence of a gas intake, i.e., with the gas feed line shut off. Since the pumping energy needed for effecting such a limited mixing is very great, however, the power demand for driving the rotor becomes very high and necessitates the provision of an oversized motor. The pumping energy could, of course, be adapted to the requisite mixing action by controlling the rotational speed of the rotor, but effecting such a control of the rotational speed is expensive. Over and above that it is difficult to achieve a satisfactory correlation between the aeration with a predetermined quantity of air and the required pumping energy for a limited mixing in a given size of liquid container.

BRIEF DESCRIPTION OF THE INVENTION

It is, therefore, the primary object of the present invention to provide an apparatus for selectively aerating a liquid by injecting a gas into the same or mixing the liquid without a gas influx, in such a manner that advantageous operating conditions in terms of both aeration and pumping circulation of the liquid can be economically achieved.

Starting from the vantage point of the hereinbefore described known liquid aerating apparatus, the present invention achieves the stated objectives by virtue of the fact that in the angular gaps or spaces between the vanes of the rotor there are provided respective guide plates or shields for separating or shielding the gas flow coming out of the gas exit openings of the vanes from the liquid flow axially entering the rotor.

The invention is based on the realization that when the gas feed line of such an apparatus is closed, the power requirement for aerating the liquid rises substantially more than is expected from theoretical calculations. This is due to the fact that upon closing of the gas feed line, the increased suction then generated in the rotor causes liquid which is moving circularly with the rotor between the vanes thereof to be sucked back into the rotor through the gas exit openings. It is this back suction of the liquid into the rotor which, when the gas feed line is closed, is substantially restricted or inhibited by the guide plates or shields arranged in the angular inter-vane spaces of the rotor, as a result of which the power requirement for the pumping circulation of the liquid in the absence of a gas injection rises only minimally. In this way it becomes possible to design the drive system for the rotor so as to meet the power requirements for the liquid circulation without having to make allowances for an economically unacceptable oversizing of the drive system for the aeration. By virtue of the shielding of the gas exit openings from the liquid, the latter can flow only along the guide plate surfaces facing away from the gas exit openings. The liquid, depending on the requirements in any given case, can be drawn into the rotor either from above or from below the rotor but not from both horizonal faces of the rotor at the same time.

The guide plates which are interposed between the gas flow emanating from the gas exit openings and the liquid flow going into the rotor have the effect, when the gas feed line is open, that the mixing of the gas and the liquid is shifted to a somewhat greater extent into the region of the stator than would be the case in the absence of the guide plates. This, however, has no disadvantageous effect on the fine distribution of the small gas bubbles in the liquid expelled from the stator, as long as the guide plates do not extend over the full rotor height. If they do, the effect is to shift the location of the mixing of the gas and liquid completely into the stator flow channels, with the slight adverse consequence that the bubbles would tend to become somewhat larger than desired, thereby reducing the oxygen transfer efficiency. Therefore, as a practical matter, to achieve on the one hand a well shielded gas exit during anaerobic mixing and on the other hand the smallest possible bubble size during aeration, the guide plates should extend over at least one-half of the rotor height (the vertical distance between its upper and its lower horizontal faces). Nevertheless, it is within the contemplation of the present invention that the guide plates may extend over anywhere between one-half and the full rotor height, and all such sizes of the guide plates are deemed to be acceptable as far as the performance of the desired shielding function is concerned and to be within the scope of the present invention. An extension over about 80% of the rotor height will, however, many times give the best results, for both mixing and aeration purposes.

In order to dispose the guide plates in an advantageous arrangement (from the standpoint of fluid flow conditions), the guide plates, which are connected, by welding or by means of screws or bolts, at one (the leading) edge thereof to the trailing flanks of the respective rotor vanes in the region or vicinity of that one of the horizontal faces of the rotor where the liquid entry takes place, are inclined (as viewed in the circumferential direction) toward the other horizontal face of the rotor. The liquid which flows into the inter-vane gaps or spaces of the rotating rotor generally axially of the rotor is deflected outwardly by the rotor vanes toward the flow channels of the stator. Especially advantageous conditions result when the guide plates (as viewed in the circumferential direction) extend at an angle of inclination to the horizontal, preferably between about 25° and 60°, which is best suited for the inflow direction of the liquid. This inflow direction is determined by the axial flow velocity of the liquid entering the rotor, which depends on the liquid head in the container, and by the rotational speed of the rotor.

To the end of ensuring that an advantageous shielding effect between gas and liquid is achieved and that a back suction of liquid into the hollow rotor in the case of a closed gas feed line is properly inhibited, each of the guide plates must provide the requisite separation between the gas flow and the liquid flow over substantially the full width of its respective inter-vane gap of the rotor. Here it should be kept in mind that for obvious reasons the outwardmost vertical edges or tips of the rotor vanes are disposed to run along a locus spaced about 1 mm from the locus of the inwardmost edges of the flow channels of the stator; in other words, the effective outer diameter of the rotor which is defined by the locus of the vane tip edges is approximately 1 mm smaller than the diameter of the imaginary cylinder on which the said flow channel edges are located. As a practical matter, therefore, the outer side edges of the guide plates will ordinarily be disposed along the locus of the vane tips and hence will be spaced the same distance from the said imaginary cylinder as the vane tips. However, this is not absolutely essential, and the spacing of the guide plate edges from the cylinder can be somewhat greater than that of the vane tips, on the order of perhaps a few millimeters, without adversely affecting the shielding function of the guide plates. The inner side edges of the guide plates can be firmly secured, preferably by being welded or screwed, to the leading flanks of the respective vanes.

The design of the rotor drive for meeting the power requirements of the anaerobic liquid circulation without gas infeed or aeration enables the apparatus to be selectively operated either for anaerobic liquid circulation or for aeration at the same speed of rotation of the rotor, which leads to especially simple constructional features and ensures a well-balanced drive for both types of operation. In this connection it must be noted that the rotational speeds of the rotor in general are so selected that, at the given height of the liquid in the container, gas cannot be aspirated into the rotor in the absence of an excess pressure. Under such conditions, therefore, when an anaerobic mixing of the liquid is to be performed following an aeration operation, it is not even essential to shut the gas feed line positively; rather it will be sufficient merely to deactivate the blower or other device applying the required excess pressure to the gas flowing through the gas feed line. For the purpose of an aeration operation, depending on the selected excess pressure applied to the gas being fed into the rotor, the power requirement turns out to be approximately 0.7 times the power requirement for a non-aerating liquid circulation operation.

In order to enable the power demand to be kept low, large quantities of liquid must be displaced at low flow speeds. From this follows a requirement for rotational rotor speeds as low as possible and for larger rotor dimensions. In order to satisfy these requirements, it is contemplated that the rotor drive will be controlled so as to ensure that the rotational speed of the rotor will be at most about 600 rpm and preferably will be between about 150 and 500 rpm.

When a non-uniform gas distribution exists over the basal area of the liquid container, there results in the presence of larger gas quantities, by virtue of the greater liquid circulating flow caused by the lifting effect of the gas, a shorter residence time of the small gas bubbles in the liquid, and that results in a smaller interaction between the gas and the liquid. This makes it advisable to achieve an especially uniform gas distribution over the cross-section of the container. To this end, the flow channels of the stator may be elongated by having connected to their discharge ends respective distributing pipes which are provided with transversely directed longitudinal distribution openings. The presence of such distributing pipes provides a larger outflow region for the gas-liquid mixture. The distribution openings, which may be directed upwardly or laterally, enable a gas outflow distributed over the lengths of the distributing pipes to be achieved, so that a merging of the fine gas bubbles with each other within the distributing pipes into the form of larger, aerobically less efficient gas bubbles is inhibited. In the case of a displacement of only a liquid without any injected gas through the distributing pipes, a part of the liquid stream likewise escapes from the distributing pipes through the distribution openings provided therein, which turns out to be advantageous for the limited circulation of the liquid in the region of the container over which the distributing pipes extend.

Since the pressure in the distributing pipes decreases in the direction away from the stator while at the same time the container area to be aerated increases, it is possible to construct the distributing pipes so that the widths or cross-sectional areas of the distribution openings increase in the outward direction over the lengths of the pipes. With such an arrangement one can ensure that, on the one hand, in the case of an aeration operation a substantially uniform distribution of the gas bubbles over the cross-section of the container is effected and that, on the other hand, in the case of an anaerobic liquid circulation without gas injection a limited circulatory motion with no disturbance of the surface of the liquid can be effected. Especially simplified constructional relationships result in this regard when the distribution openings consist of longitudinal slits provided in the walls of the distributing pipes.

BRIEF DESCRIPTION OF THE DRAWINGS

The foregoing and other objects, characteristics and advantages of the present invention will be more clearly understood from the following detailed description thereof when read in conjunction with the accompanying drawings, in which.

DETAILED DESCRIPTION OF THE INVENTION

Figure 1:
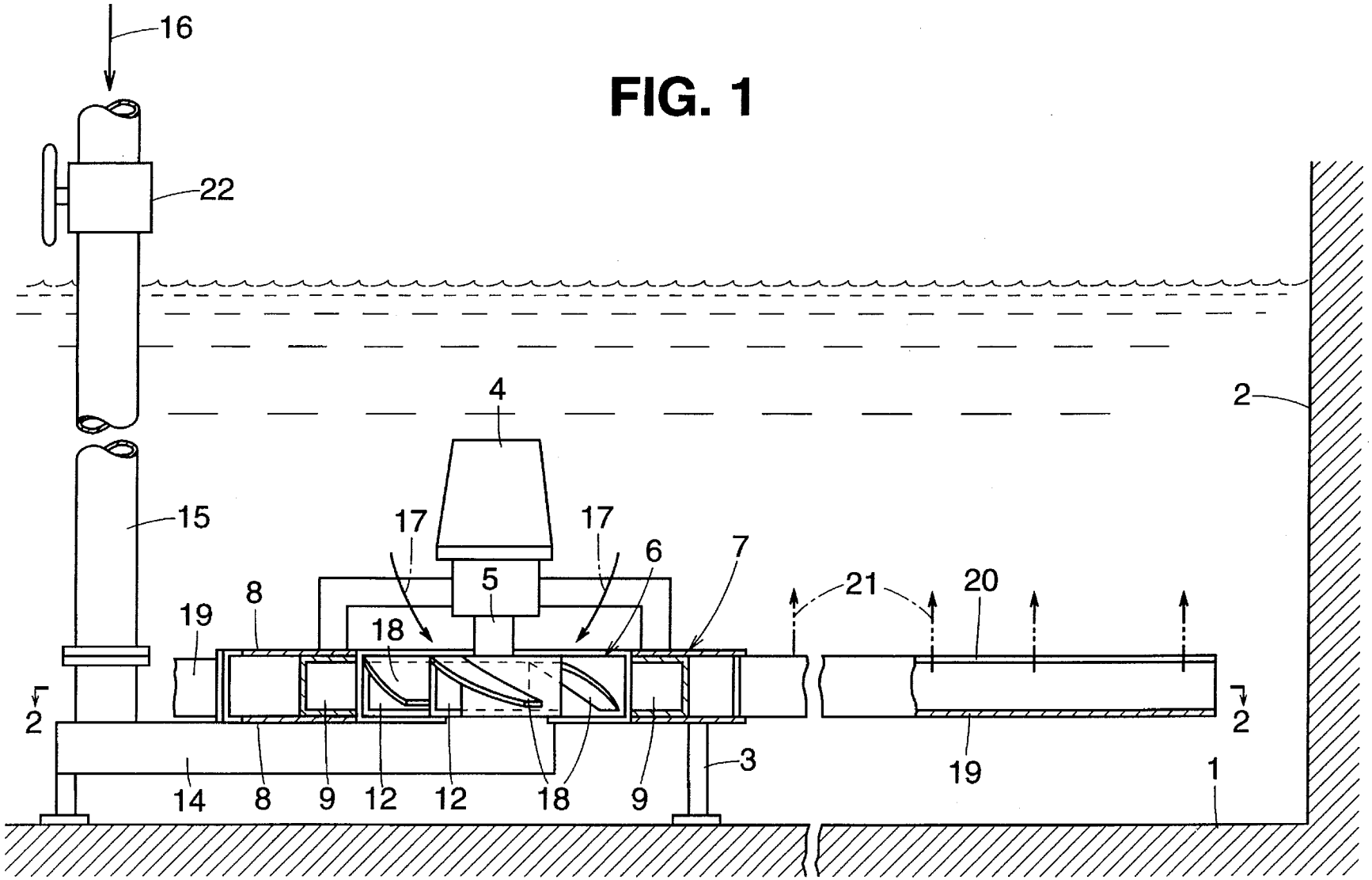
FIG. 1 is a partly sectional side elevational view of an apparatus according to the present invention for selectively treating a liquid in a container either by means of an aeration operation with an injection of gas into the liquid or by means of an anaerobic pure circulation operation without an injection of gas into the liquid.
Figure 2:
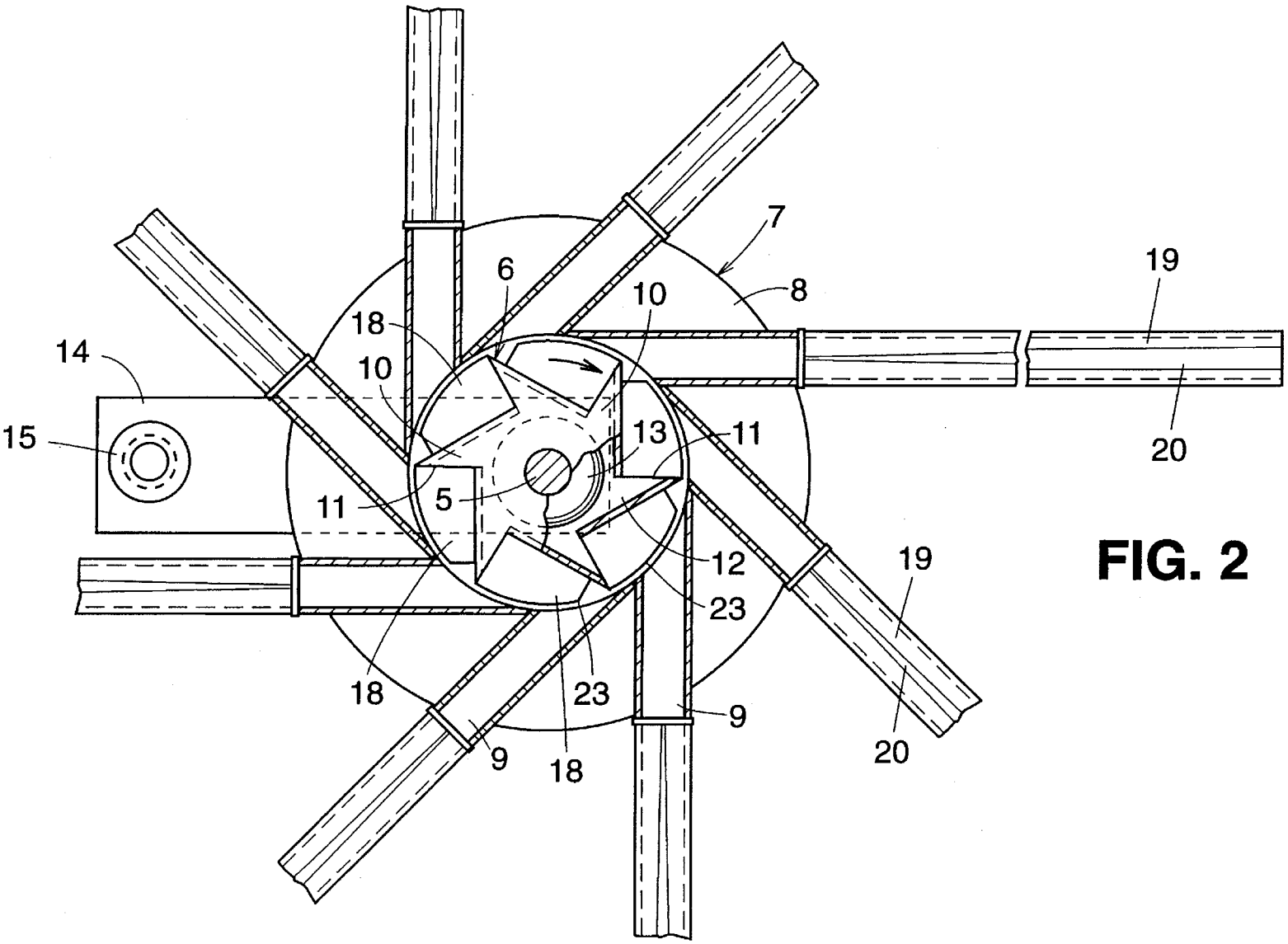
FIG. 2 is a partly sectional fragmentary top plan view of the apparatus shown in FIG. 1, the view being taken along the line II—II in FIG. 1.
Figure 3:
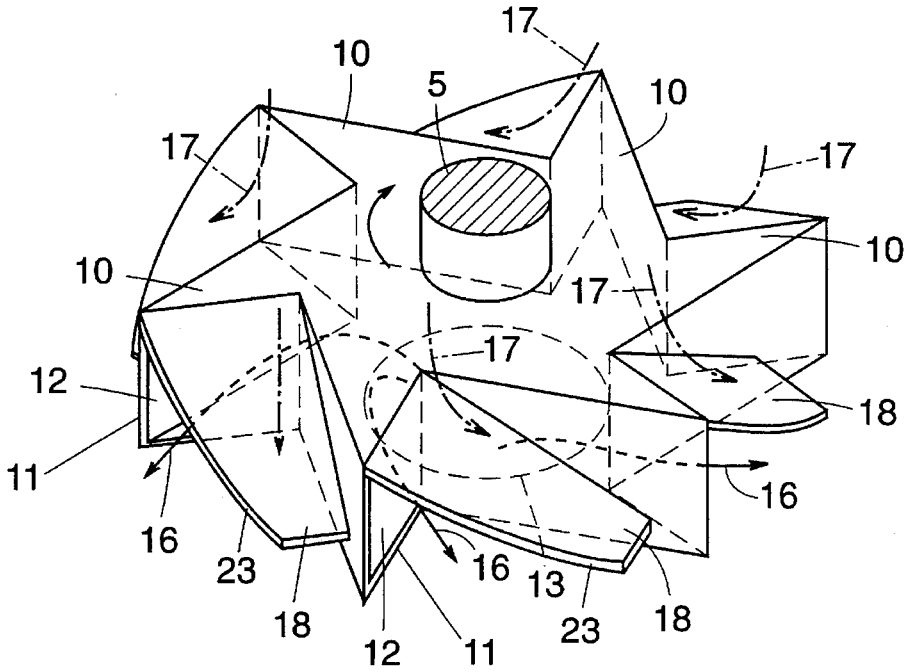
FIG. 3 is a simplified perspective illustration, drawn to an enlarged scale, of the rotor of the apparatus according to the present invention shown in FIGS. 1 and 2.

Referring now to the drawings in greater detail, in the embodiment of the invention illustrated in FIGS. 1–3 the apparatus for selectively aerating or anaerobically mixing a liquid includes a framework 3 positioned on the bottom or floor 1 of a basin, lagoon, tank or like container 2 and supporting a drive motor 4 having a shaft 5 for rotating a rotor 6 about a vertical axis, the rotor having horizontal upper and lower faces. The framework 3 further supports a stator 7 which surrounds the rotor 6 and includes two annular or ring-shaped plates 8 between which the stator is provided with a series of ducts defining a plurality of flow channels 9 the axes of which are angularly oriented or inclined, in the direction of rotation of the rotor 6, relative to the respectively associated radial directions, as is best shown in FIG. 2. The rotor 6 is hollow and has a star-shaped form with a plurality of arms or vanes 10 the trailing flanks 11 of which, as viewed in the direction of rotation of the rotor 6, preferably are located in axial planes (i.e., they extend radially of the rotor) and define respective gas exit openings 12. The hollow interior of the rotor 6 communicates through at least one opening 13 (FIGS. 2 and 3) in the lower horizontal face of the rotor with the inward end of a gas connector duct 14 which is also supported by the stator 7 and to the outward end of which a gas feed line 15 is connected. In the apparatus according to this embodiment of the present invention, therefore, since the gas 16, generally air, to be injected into the liquid is fed from the feed line 15 to the rotor 6 via the connector duct 14 along the underside or lower face of the stator under an excess pressure provided by a suitable blower, compressor or like mechanism (not shown), the liquid intake or inflow is provided at the upper face of the stator, as is indicated by the flow arrows 17. Merely by way of example, the acute vane tip angles, which are defined in each vane between the vertical leading flank thereof and a radial plane passing through the tip of that vane and coinciding with the vertical trailing flank 11 of the latter, are between 30° and 40°, and the acute angle of orientation of each stator flow channel 9 relative to the associated radial direction passing through the outwardmost end of that flow channel is between 30° and 45°.

To the extent so far described, the apparatus of FIGS. 1–3 is generally similar to the apparatus described in the applicants' copending prior application Ser. No. 120,005 filed Sep. 10, 1993, now U.S. Pat. No. 5,356,570, and assigned to the same assignee as the present application. The rotor 6 of the apparatus according to the present invention differs from the rotor of the prior apparatus, however, in that the present rotor is provided in the spaces or gaps between the adjacent vanes 10 with respective guide plates or shields 18 which extend obliquely from one of the flat horizontal faces of the rotor toward the other flat horizontal face thereof, are inclined relative to the horizontal at an angle of between about 25° and 60°, and at least in the direct vicinity of the gas exit openings 12 effect a separation between the liquid from the container 2 flowing in the direction of the arrows 17 into those spaces or gaps and the gas flows issuing from the gas exit openings 12. As can be seen from FIGS. 2 and 3, the inner side edges of the guide plates 18 are secured, by welding or screwing, to the leading flanks of the respective trailing vanes 10, while the leading end edges of the guide plates are secured in like manner to the top edges of the trailing flanks 11 of the respective leading vanes. The choice of either type of affixation of the guide plates to the rotor will depend on whether the system is to be a permanent and invariable installation, in which case welding is preferred, or whether either the liquid head or the rotor speed or both are to be variable, in which case the use of screws or bolts permitting adjustment (e.g., replacement by differently angled plates) of the guide plates is preferred. The intimate mixing of the liquid and gas entering the inter-vane gaps of the rotor 6 when the gas feed line 15 is open takes place essentially within the flow channels 9 of the stator 7 through which the gas and liquid are driven outwardly by the rotor as it rotates.

In order to ensure the attainment of advantageous discharge conditions for the so-formed gas-liquid mixture, a plurality of more or less elongated distributing pipes 19 may be connected to the discharge ends of the flow channels 9 of the stator 7. The pipes 19 (which may be round or flat-sided in cross-section) are provided either at their upper sides or at one or both of their lateral sides with distribution openings 20 extending longitudinally of the pipes between the inlet and outlet ends of the pipes, each such opening, for example, being preferably in the form of a longitudinal slit (or optionally in the form of a longitudinal series of smaller apertures) which preferably becomes gradually wider in the direction of the outlet end of its respective distributing pipe, as best shown in FIG. 2. The lengths of the distributing pipes in any given installation according to the present invention will normally range from about 0.5 m to about 2 m, depending on the size of the container, although in a very large container the pipes may be considerably longer, up to as much as about 5 m. In any such installation, furthermore, the widths of the distribution openings in the respective distributing pipes will also generally depend on the size of the container and the desired aeration rate as well as on the cross-sectional sizes of the pipes; thus, in the case of constant width openings, their widths will normally range from about 3 mm to about 30 mm (given a pipe width of about 35–100 mm), whereas in the case of openings which gradually increase in width from the inlet end to the outlet end of each pipe the widths of the openings may range from about 1 mm to 20 mm at the inlet ends and from about 10 mm to about 90% of the pipe width at the outlet ends.

The gas-liquid mixture leaving the flow channels 9 is consequently conducted further away from the rotor through the interiors of the distributing pipes 19, with small gas bubbles distributed over the length of each pipe escaping from the latter through its respective longitudinal slit or slits 20 into the body of liquid in the container, as is indicated by the flow arrows 21 in FIG. 1. It will be understood, in this regard, that whereas in case of distributing pipes having upwardly directed slits or distribution openings therein, the masses of bubbles rise in curtain-like fashion through the liquid, the use of distributing pipes having laterally directed slits or distribution openings therein will permit a more extensive distribution of the bubbles and enable a higher rate of aeration to be achieved. With either type of arrangement, however, it is ensured that a uniform distribution of fine small gas bubbles is achieved in the body of liquid in the container throughout the region thereof above the entire radial extent of the distributing pipes 19. For ease of installation, these pipes may be linked or hinged to the stator 7 for upward and downward swinging movements between a substantially horizontal position and an upwardly inclined position (for the sake of simplicity, this arrangement has not been illustrated in the drawings of the present application, but a representative construction of such a hinged connection is fully disclosed in the applicants' aforesaid copending prior application Ser. No. 120,005, as are representative constructions of slip-on or telescopic fittings for connecting the distributing pipes to the flow channels, and those disclosures are incorporated herein by this reference).

In order to be able to achieve, by means of the illustrated apparatus, an advantageous liquid circulation without gas injection, which would be suitable, for example, for a denitrification procedure, one needs only either to close a valve 22 incorporated in the gas feed line 15 or to deactivate the blower, compressor or other device which serves to pressurize the gas being delivered to the rotor through the gas feed line, so that no gas will be either aspirated or forced under pressure into the rotor 6. The guide plates 18 then serve to ensure that liquid in large quantities will not be sucked into the rotor through the gas exit openings 12 at the trailing flanks 11 of the rotor vanes 10 due to the strengthened suction generated in the rotor when the gas feed line 15 is closed, and thus they also prevent such large quantities of liquid from being carried along by the rotating rotor which would materially increase the power requirement for the pumping action without gas injection, as will be understood from the curves a and b in the graph of FIG. 6. These curves show, for a given rotor, the dependence of the power consumption of the rotor drive on the injected quantity of gas, the curves representing the respective relationships for a rotor not equipped with guide plates 18 and for a rotor equipped with such guide plates. The curve a, which represents the power to gas flow relationships in the case of a rotor without guide plates 18, shows that as the rate of gas injection increases, the power demand decreases substantially from its highest value to its lowest value, while the curve b, which was plotted for an identical rotor but equipped with guide plates 18, has a substantially flatter slope with its highest value being not too much greater than its lowest value. From FIG. 6, therefore, one can readily visualize the considerably lower power demand in the case of a rotor having guide plates versus the case of a rotor having no guide plates. The distinction is especially evident in the case of a liquid circulation without gas injection (aeration rate=0 $m^3/h$), but even at higher aeration rates, the relationships clearly favor the situation of a rotor with guide plates over a rotor without guide plates.

To ensure an appropriate separation between the gas flow 16 and the liquid flow 17, the guide plates 18 are connected to the trailing flanks 11 of the rotor vanes 10 in the vicinity of that horizontal face of the rotor which is proximate to the entry location of the liquid flow into the rotor, and they extend, as viewed circumferentially of the rotor, obliquely toward the other horizontal face of the latter. The outer edges 23 of the guide plates 18 are located either precisely on the circular locus of the tips of the rotor vanes 10 or at most, as previously mentioned, on a locus the diameter of which is slightly smaller (by at most a few millimeters) than that of the vane tip locus, so that most of the liquid entering the inter-vane gaps or spaces will flow over and along the surfaces of the guide plates which face toward the liquid entry locations and will be guided thereby directly into the flow channels 9 where the major part of the mixing of gas and liquid will take place. Some of the liquid will, of course, pass over the trailing ends and the outer side edges of the guide plates into the portions of the inter-vane spaces located therebelow and will be mixed there with the gas emerging from the gas exit openings 12 before entering the flow channels 9. That, however, is no disadvantage in an aeration operation, and would also not be disadvantageous in the absence of a gas inflow during an anaerobic mixing operation because the portion of the liquid that would be subjected to the back suction of the rotor will be very small and will not place an excessive load onto the rotor drive.

Because it is necessary to shield the gas exit openings 12 from the incoming liquid as much as possible, the liquid entry into the rotor 6 can only take place from one of the two horizontal faces of the rotor; in other words, the liquid feed can be effected either from above or from below the rotor, but not from both sides simultaneously, depending on the requirements in any given case. The gas feed into the rotor can, as desired, also be effected from either face of the rotor, but likewise only from one face in any given case, and that face may be either the face proximate to the liquid entry location or the face remote from the liquid entry location. In terms of practical application, therefore, the apparatus according to the embodiment of FIGS. 1–3 is characterized, as previously indicated, by an arrangement in which the gas is fed into the rotor from below and the liquid enters the rotor from above. Accordingly, the rotor drive motor 4 in this case is located above the rotor 6, and entry of liquid into the rotor from below is prevented with the aid of a suitable labyrinth packing or seal (not shown), for example, such as is identified by the reference numeral 6 in the above-mentioned U.S. Pat. No. 3,891,729. With the liquid entry into the rotor being from above, of course, the guide plates 18 slope downwardly from the upper face of the rotor in a direction opposite to the direction of rotation of the rotor.

Figure 4:
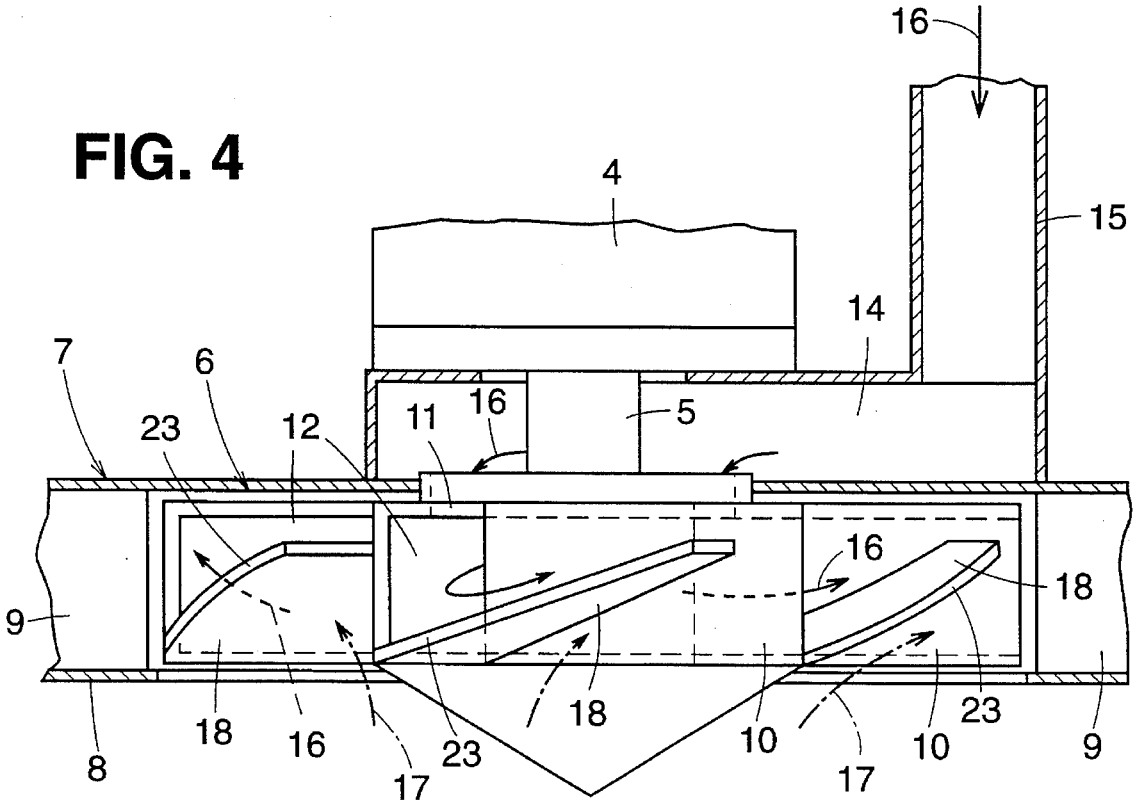
FIG. 4 is a fragmentary, partly sectional side elevational view of an apparatus according to a modified embodiment of the present invention and illustrates an appropriately modified construction of the rotor in axial section.

FIG. 4 shows an arrangement corresponding to that of FIGS. 1–3 but designed for the situation where the liquid feed, designated by the arrows 17, is effected from below while the gas flows into the rotor from above designated by the arrows 16. The rotor shaft 5 thus necessarily passes through the gas connecting duct 14 and at its entry juncture with the latter is provided with a suitable sealing means, for example, a labyrinth packing or seal (not shown) or the like, to prevent entry or liquid into the rotor from above. The guide plates 18 in this case must, therefore, slope upwardly from the lower face of the rotor toward the upper face thereof in a direction opposite to the direction of rotation of the rotor, in order to shield the gas exit openings 12 and prevent any sucking of the liquid back into the hollow rotor when the gas feed line 15 is closed.

Figure 5:
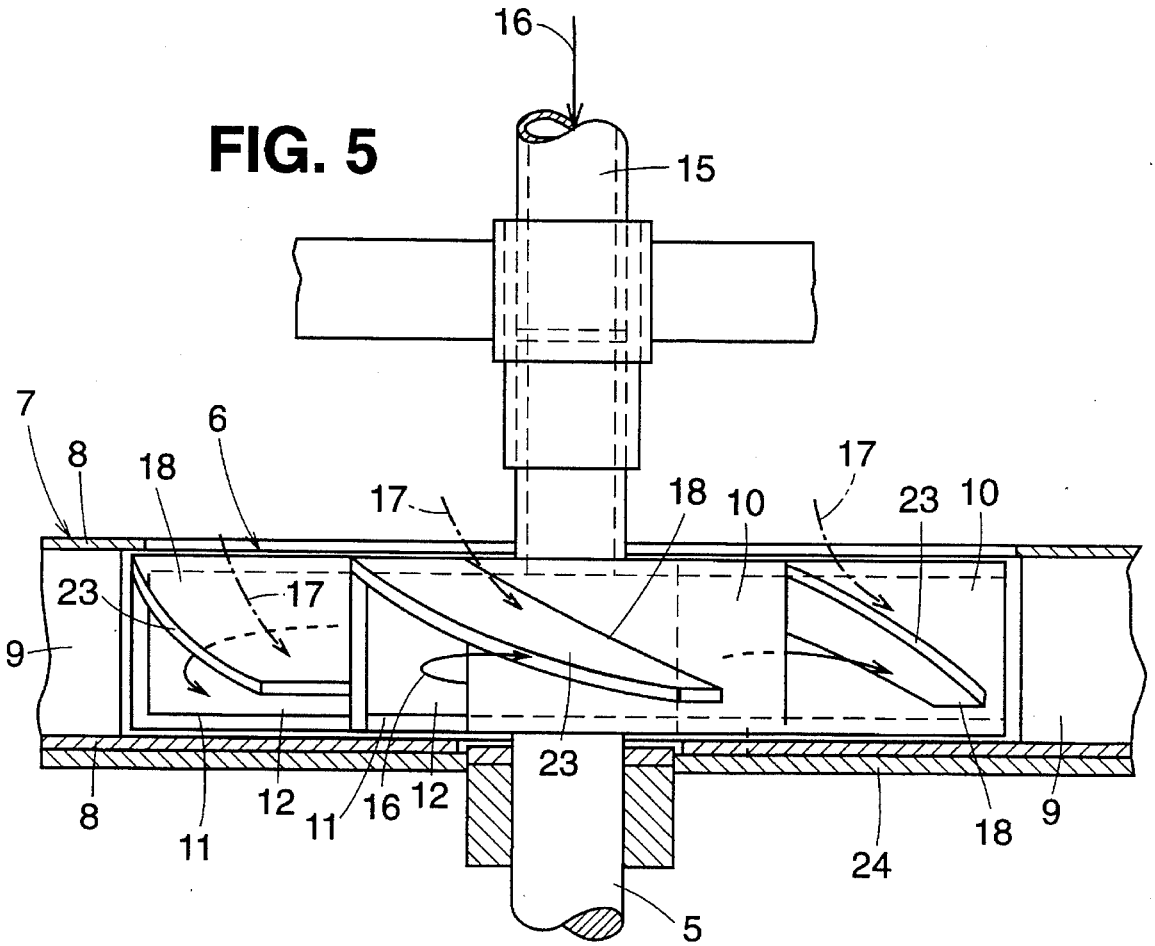
FIG. 5 is a view similar to FIG. 4 of an apparatus according to a further modified embodiment of the present invention.

FIG. 5 shows a further embodiment of the present invention, in which the rotor shaft 5 extends through the bottom wall 24 of the container 2 (this would normally be the case when the container is a steel tank or the like which is mounted on legs so as to be spaced from the underlying ground or other support surface) and the stator 7 is seated directly on the bottom wall 24, i.e., without an interposed framework 3 such as is shown in FIG. 1. In this arrangement, both the gas feed 16 and the liquid feed 17 are effected from above, with the gas being fed through the feed line 15 directly into the hollow interior of a tubular stub shaft or axle which extends upwardly from the rotor 6 (the proximate lowermost end region of the feed line and uppermost end region of the stub shaft are enclosed in a suitable rotary seal) and at its bottom end communicates with the hollow interior of the rotor. The guide plates 18, therefore, must slope downwardly from the upper surface of the rotor in a direction opposite to the direction of rotation of the rotor, as in the embodiment of FIGS. 1–3, in order to accommodate the liquid feed from above and to effect the required shielding of the gas exit openings 12 against the entry of liquid.

The following example will more clearly illustrate some of the operational features and advantages of the present invention.

In order to aerate waste water in a cylindrical container having a diameter of 9.1 m and a filled height (liquid head) of 6.3 m, with 840 $m^3/h$ of air, an apparatus according to the present invention was installed in the container, the apparatus including a multi-vaned rotor with an effective outer diameter of 540 mm at the vane tips, a height of 85 mm, and a series of sloping guide plates in the inter-vane spaces, the guide plates being inclined at an angle of 37° to the horizontal and extending over substantially 100% of the rotor height. The stator was provided with ten flow channels, each of a rectangular cross-section of 90×100 mm. The outer diameter of the stator was 1,050 mm. These flow channels were extended by means of distributing pipes each 2 m long which were provided at their upper sides with respective longitudinal slits 10 mm wide. The excess pressure on the air to be injected into the liquid was adjusted by means of a suitable blower to 453 mbar. With the aid of a drive motor having a rated output of 22 kW, the rotor was driven at 346 rpm. Under these conditions, air at the rate of 840 $m^3/h$ was fed into the rotor and was uniformly distributed by the apparatus over the basal area of the waste water container. The density of the gas-liquid mixture was 706 $kg/m^3$. The power demand of the aerator was 15.1 kW, while the power demand of the blower was 15.3 kW, so that the total power demand was 30.4 kW. The standard oxygen transfer rate was 72.8 kg $O_2/h$, which calculates to a standard aeration efficiency of 2.39 kg $O_2/kWh$ and a standard oxygen transfer efficiency of 29.0%.

In order to go from this operation to a liquid circulation without gas injection, it was only necessary to turn off the blower and, if deemed advisable, to close the gas feed line. At the same rotational speed of the rotor, water entered the inter-vane spaces of the rotor at the rate of 1860 $m^3/h$, and the power demand of the rotor drive was 21.6 kW, which was sufficient for holding the sludge in the waste water container in suspension and especially without causing any movement of the surface of the body of liquid which would have been detrimental for the anaerobic nitrogen separation.

Figure 6:
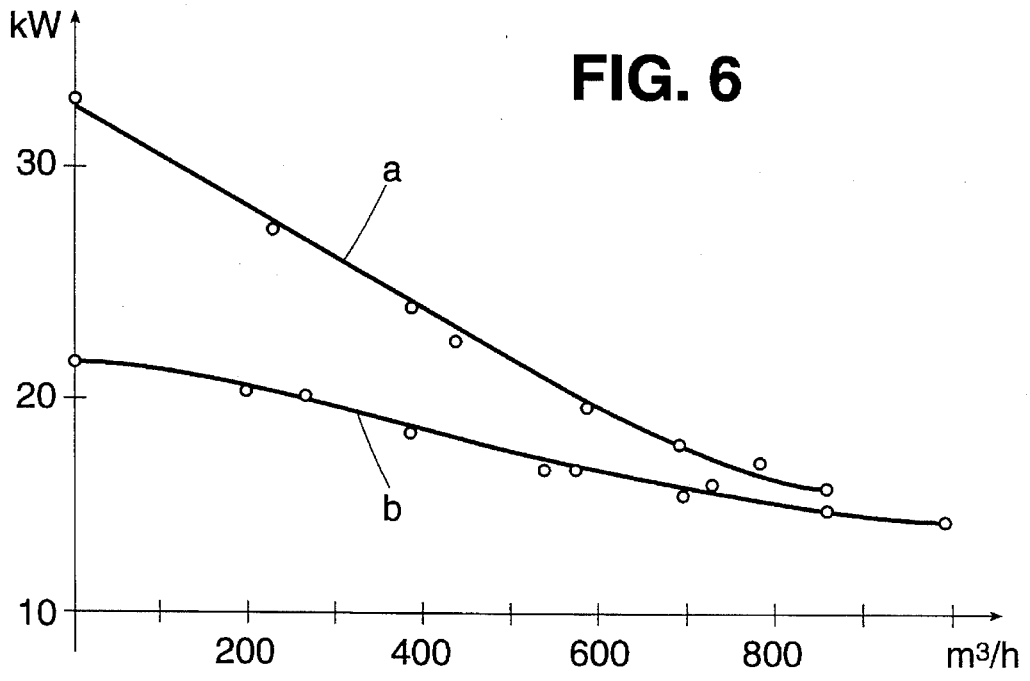
FIG. 6 is a graph illustrating a plot of the dependence of the power consumption of the rotor drive on the quantity of air distributed by a rotor both with and without guide plates in the inter-vane gaps thereof.

It should be pointed out that the benefits of the use of inclined guide plates in both the aeration operation and the anaerobic mixing operation are represented by curve b of FIG. 6, which shows that at an air feed rate of 840 $m^3/h$ the power demand was 15.1 kW, while at a 0.0 $m^3/h$ feed rate (air fully throttled) the power demand was 21.6 kW, a tolerable increase. As shown by curve a, when the apparatus was run under identical conditions but without any guide plates in the rotor, the power demand was 17.6 kW at an air feed rate of 840 $m^3/h$ and an intolerably higher 33 kW at a 0.0 $m^3/h$ air feed rate. This clearly exemplifies the adaptability of the rotor equipped with guide plates to the performance of anaerobic mixing operations.

It will be understood that the foregoing description of preferred embodiments of the present invention is for purposes of illustration only, and that the various structural and operational features herein disclosed are susceptible to a number of modifications and changes none of which entails any departure from the spirit and scope of the present invention as defined in the hereto appended claims.

We claim:

1. Apparatus for selectively aerating or anaerobically mixing a liquid in a container, the apparatus including a hollow star-shaped rotor which has a plurality of circumferentially spaced horizontally outwardly extending hollow vanes and is adapted to be mounted in the region of the bottom of the container for rotation about a vertical axis, drive means for rotating said rotor about said vertical axis, said rotor having opposite faces directed upwardly and downwardly, respectively, a gas feed line having one end in communication with a source of gas to be introduced into said liquid and another end in communication with the hollow interior of said rotor at one of said faces thereof, each of said vanes having a leading and a trailing flank, as viewed in the direction of rotation of said rotor, and being provided in said trailing flank with a respective gas exit opening, the spaces between circumferentially adjacent vanes of said rotor being open at one of said faces of said rotor to define entry locations for enabling liquid in the container to enter said spaces, and a stator adapted to be stationarily mounted in the container in surrounding relation to said rotor and defining a plurality of circumferentially spaced outwardly extending flow channels for receiving liquid from said spaces between said vanes and for directing said liquid away from said rotor;

wherein the improvement comprises:

(a) means for supplying gas under an excess pressure from said source into and through said gas feed line; and (b) a plurality of guide plates each located in a respective one of said spaces between said vanes and carried by said rotor so as to be interposed between said gas exit opening communicating with that space and said liquid entry location of that space, said guide plates serving to shield the respective gas exit openings either for separating the gas flows exiting through said gas exit openings from the liquid flowing into said spaces between said vanes when gas is flowing through said gas feed line or for preventing liquid flowing into said spaces between said vanes from being sucked into said rotor through said gas exit openings when no gas is flowing through said gas feed line.

2. Apparatus according to claim 1, wherein said gas feed line is equipped with valve means for selectively opening and closing said gas feed line to permit or prevent a flow of gas through said gas feed line to said rotor.

3. Apparatus according to claim 1, wherein said guide plates are secured to said trailing flanks of the respective vanes at attachment locations in the vicinity of that face of said rotor which defines said liquid entry locations, said guide plates are inclined from said attachment locations toward the face of said rotor remote from said liquid entry locations, and each of said guide plates extends over at least one-half the vertical distance between said faces of said rotor.

4. Apparatus according to claim 3, wherein each of said guide plates extends over between 50% and 100% of the vertical distance between said faces of said rotor.

5. Apparatus according to claim 1 or 3, wherein said drive means is controlled for rotating said rotor at substantially the same rotational speed irrespective of whether gas is or is not flowing through said gas feed line.

6. Apparatus according to claim 1 or 3, wherein said drive means is controlled to provide a rotational speed of said rotor of at most 600 rpm irrespective of whether gas is or is not flowing through said gas feed line.

7. Apparatus according to claim 1 or 3, wherein said drive means is controlled to provide a rotational speed of said rotor of between 150 and 500 rpm irrespective of whether gas is or is not flowing through said gas feed line.

8. Apparatus according to claim 1 or 3, wherein said vanes have respective outwardmost tip edges disposed on a first common circular locus which defines the effective outer diameter of said rotor, said flow channels of said stator have respective intake end edges disposed on a second common circular locus which surrounds said first common circular locus and is spaced approximately 1 mm therefrom, and said guide plates have respective outer side edges disposed on a third common circular locus which has a diameter at most equal to said effective outer diameter of said rotor.

9. Apparatus according to claim 8, wherein said drive means is controlled for rotating said rotor at substantially the same rotational speed irrespective of whether gas is or is not flowing through said gas feed line.

10. Apparatus according to claim 8, wherein said drive means is controlled to provide a rotational speed of said rotor of at most 600 rpm irrespective of whether gas is or is not flowing through said gas feed line.

11. Apparatus according to claim 8, wherein said drive means is controlled to provide a rotational speed of said rotor of between 150 and 500 rpm irrespective of whether gas is or is not flowing through said gas feed line.

12. Apparatus according to claim 1 or 3, wherein respective distributing pipes having inlet and outlet ends are connected at said inlet ends to discharge ends of said flow channels of said stator for extending the lengths of said flow channels, and said distributing pipes intermediate said inlet and outlet ends thereof are provided with respective distribution openings extending longitudinally of said distributing pipes for enabling parts of either the gas-liquid mixture or the liquid flowing through said distributing pipes to escape transversely therefrom into the overlying body of liquid being aerated or anaerobically mixed.

13. Apparatus according to claim 12, wherein said distribution openings in said distributing pipes are in the form of longitudinal slits each provided at the upper side of its respective distributing pipe.

14. Apparatus according to claim 12, wherein each distribution opening in its respective distributing pipe increases in width in the direction of the outlet end of that distributing pipe.

15. Apparatus according to claim 14, wherein said distribution openings in said distributing pipes are in the form of longitudinal slits each provided at the upper side of its respective distributing pipe.

16. Apparatus according to claim 12, wherein said distribution openings in said distributing pipes are in the form of longitudinal slits each provided at a lateral side of its respective distributing pipe.

17. Apparatus according to claim 12, wherein each distribution opening in its respective distributing pipe increases in width in the direction of the outlet end of that distributing pipe.

18. Apparatus according to claim 17, wherein said distribution openings in said distributing pipes are in the form of longitudinal slits each provided at a lateral side of its respective distributing pipe.

* * * * *